US006938387B2

(12) United States Patent
Belanger

(10) Patent No.: US 6,938,387 B2
(45) Date of Patent: Sep. 6, 2005

(54) LENGTH ADJUSTABLE COMPOSITE STUD

(76) Inventor: Ghislain Belanger, 8387, rue Rejane, Lasalle QBC (CA), H8N 3C3

( * ) Notice: Subject to any disclaimer, the term of this patent is extended or adjusted under 35 U.S.C. 154(b) by 0 days.

(21) Appl. No.: 10/438,025

(22) Filed: May 15, 2003

(65) Prior Publication Data

US 2003/0213204 A1 Nov. 20, 2003

Related U.S. Application Data

(63) Continuation-in-part of application No. 10/145,789, filed on May 16, 2002, now abandoned.

(51) Int. Cl.[7] ..... E04H 12/18

(52) U.S. Cl. ..... 52/645; 52/733.2; 52/737.3; 52/481.1

(58) Field of Search ..... 52/376, 481.1, 52/731.5–731.9, 733.2, 737.3, 645

(56) References Cited

U.S. PATENT DOCUMENTS

| | | | | | |
|---|---|---|---|---|---|
| 3,528,636 | A | | 9/1970 | Schmidt | |
| 4,001,993 | A | * | 1/1977 | Daniels | 52/376 |
| 4,466,225 | A | | 8/1984 | Hovind | |
| 4,971,280 | A | | 11/1990 | Rinderer | |
| 5,072,547 | A | | 12/1991 | DiFazio | |
| 5,222,335 | A | * | 6/1993 | Petrecca | 52/105 |
| 5,452,556 | A | * | 9/1995 | Taylor | 52/730.7 |
| 5,590,505 | A | * | 1/1997 | Bogle | 52/731.9 |
| 5,609,006 | A | | 3/1997 | Boyer | |
| 5,625,997 | A | * | 5/1997 | Callahan et al. | 52/737.3 |
| 5,713,176 | A | * | 2/1998 | Hunt | 52/731.5 |
| 6,250,042 | B1 | | 6/2001 | Rudd | |
| 6,374,558 | B1 | * | 4/2002 | Surowiecki | 52/241 |
| 6,523,315 | B2 | * | 2/2003 | Ford | 52/514 |

* cited by examiner

*Primary Examiner*—Jeanette E. Chapman
(74) *Attorney, Agent, or Firm*—Equinox Int'l; Franz Bonsang, Patent Agent

(57) ABSTRACT

A length adjustable composite stud combining the advantages associated with metal studs with the advantages associated with conventional wood studs. The composite stud also allows for customized adjustments of its length using a set of simple and ergonomic steps. The composite stud includes a generally elongated frame member defining a generally open base channel. The composite stud also includes a core component configured and sized for allowing insertion thereof in the base channel. A transversal movement limiting component prevents relative movement between the core component and the frame member in a direction other then that of the frame longitudinal axis. A longitudinal movement limiting structure releasably retains the core component within the base channel in a core first position wherein a core longitudinal end is generally in register with a frame longitudinal end. The longitudinal movement limiting structure selectively allows longitudinal movement of the core component.

23 Claims, 5 Drawing Sheets

LENGTH ADJUSTABLE COMPOSITE STUD

CROSS-REFERENCE TO RELATED APPLICATION

The present application is a Continuation-In-Part (C.I.P.) application of patent application Ser. No. 10/145,789 filed on May 16, 2002, now abandoned.

FIELD OF THE INVENTION

The present invention relates to the general field of construction components and is particularly concerned with a length adjustable composite stud.

BACKGROUND OF THE INVENTION

Construction beams are used extensively in the construction field especially for the construction of partition walls. Indeed, partition walls typically include a framework made out of a plurality of vertical beams referred to as studs assembled together with generally horizontal beams often referred to as plates. Sheets of wall board are typically secured to both sides of the framework to produce wall surfaces.

Typically, the studs are fastened to the plates by driving nails through the outwardly facing surfaces of the plates and into the top and bottom end of each stud. This method, often referred to as "toe nailing", allows for quick and easy fastening of a stud to top and bottom plates.

Wood studs have traditionally been favored for use in construction studs for their structural characteristics as well as the ease with which they can be assembled to plates using the "toe nailing" approach. However, with time, disadvantages associated with wood studs are becoming more apparent, particularly in view of the unavailability of suitable wood materials caused the depletion of forest resources. Also, wood stud are prone to cracking and warping. They are further susceptible to termite infestation, rotting and mildew.

Accordingly, metal frames are becoming increasingly popular. Conventional metal frames are typically made out of extruded strips. When properly constructed and at appropriate thickness, conventional frames are relatively rigid, strong and structurally stable. In addition, metal frame are generally impervious to weather conditions. In facts, metal frames alleviate most of the disadvantages associated with wood studs.

One of the major disadvantages associated with the use of metal studs is the extra effort required for connecting the metal studs to the plates as compared with the relative ease with which the "toe nailing" approach can be performed with wood studs. Hence, it would be highly desirable to combine the advantages associated with metal studs with the ease of assembly afforded by the use of wood studs.

The attractiveness of combining characteristics from metal and wood studs has been recognized in the prior art. For example, U.S. Pat. No. 5,452,556 naming Jimmy R. TAYLOR as inventor and issued Sep. 26, 1995 discloses a fabricated combination of an elongated metal channel and at least two short lengths or end portions of a wooden beam. The combination forms a standard length stud having a metal central portion and exposed wooden portions.

Although somewhat useful, the structure disclosed in U.S. Pat. No. 5,452,556 nevertheless suffers from at least one major drawback. Indeed, during the construction of wall skeletal frameworks, there exists a plurality of situations wherein it is desirable to adjust the length of the wood studs. For example, the wall being erected may extend between floor and/or ceiling that are either warped or angled relative to each other. The structure disclosed in U.S. Pat. No. 5,452,556 does not allow for easy, quick and ergonomic adjustment of the length of the composite metal-wood studs. Accordingly, there exists a need for an improved length adjustable composite stud.

SUMMARY OF THE INVENTION

It is an object of the present invention to provided an improved construction stud.

Advantages of the present invention include that the proposed composite wood-metal stud combines the advantages associated with metal studs such as improved structural stability and decreased susceptibility to termite infestation, mildew and the like with the advantages associated with conventional wood studs such as the ability to join the studs to structural plates through the use of the conventional "toe nailing" approach.

The proposed length adjustable composite stud allows for customized adjustments of the length of the stud. The length of the proposed composite stud can be adjusted using a set of simple and ergonomic steps without requiring special tooling or manual dexterity.

Furthermore, the proposed length adjustable composite stud is designed so as to be manufacturable using conventional forms of manufacturing so as to provide a stud that is economical, long lasting and relatively trouble free in operation.

In accordance with an embodiment of the present invention, there is provided a length adjustable composite stud comprising: a generally elongated frame member, the frame member defining a frame longitudinal axis, a frame first longitudinal end and a generally opposed frame second longitudinal end; the frame member defining a generally open base channel, the base channel having a longitudinal channel opening; a core component, the core component defining a core longitudinal axis, a core first longitudinal end and an opposed core second longitudinal end; the core component being at least partially insertable in the base channel with the core longitudinal axis in a generally parallel relationship relative to the frame longitudinal axis to form the composite stud therewith, the core component being axially and slidably movable relative to the frame member when at least partially inserted within the base channel; transversal movement limiting means positioned between the frame member and the core component for preventing relative movement between the core component and the frame member in a direction other then the frame longitudinal axis when the core component is at least partially inserted within the base channel; longitudinal movement limiting means positioned between the frame member and the core component for releasably retaining the core component within the base channel in a core first position wherein the core first longitudinal end is generally in register with the frame first longitudinal end, the longitudinal movement limiting means selectively allowing longitudinal movement of the core component in a core first direction towards a core second position upon a moving force being applied on the core component, wherein when the core component is in the core second position, the core first longitudinal end protrudes from the frame first longitudinal end so as to adjust a length of the composite stud, while preventing the core component to be axially moved relative to the base frame from the core first position in a core second direction oriented opposite the core first direction.

In accordance with one embodiment of the invention, the longitudinal movement limiting means only allows longitudinal movement of the core component in the core first direction upon the moving force reaching a predetermined value.

In accordance with one embodiment of the invention, the core component is in the core first position and wherein the longitudinal movement limiting means includes a retaining strip, the retaining strip being secured to both the core component and the frame member for releasably preventing longitudinal movement therebetween, the retaining strip extending generally circumferentially relative to the core component and the frame member.

Conveniently, the retaining strip is releasably secured to the core component and the frame member for selectively allowing longitudinal movement therebetween.

According to an aspect of the present invention, there is provided a length adjustable composite stud comprising:

a generally elongated frame member, the frame member defining a frame longitudinal axis, a frame first longitudinal end and a generally opposed frame second longitudinal end; the frame member defining a generally open base channel, the base channel having a longitudinal channel opening;

a core component, the core component defining a core longitudinal axis, a core first longitudinal end and an opposed core second longitudinal end; the core component being configured and sized for allowing the core component to be at least partially inserted in the base channel with the core longitudinal axis in a generally parallel relationship relative to the frame longitudinal axis;

transversal movement limiting means positioned between the frame member and the core component for preventing relative movement between the core component and the frame member in a direction other then the frame longitudinal axis;

longitudinal movement limiting means positioned between the frame member and the core component for releasably retaining the core component within the base channel in a core first position wherein the core first longitudinal end is generally in register with the frame first longitudinal end, the longitudinal movement limiting means selectively allowing longitudinal movement of the core component in a core first direction towards a core second position upon a moving force being applied on the core component, wherein when the core component is in the core second position, the core first longitudinal end protrudes from the frame first longitudinal end.

Typically, the longitudinal movement limiting means only allows longitudinal movement of the core component in the core first direction upon the moving force reaching a predetermined value.

Typically, the core component is in the core first position and the longitudinal movement limiting means includes a retaining strip, the retaining strip being secured to both the core component and the frame member for releasably preventing longitudinal movement therebetween.

Typically, the retaining strip is releasably secured to the core component and the frame member for selectively allowing longitudinal movement therebetween, and the retaining strip is provided with indicia marked thereon that includes instructions relating to a method for using the length adjustable composite stud.

Preferably, the retaining strip is made out of a tearable material, the tearable material being tearable upon the moving force reaching a predetermined value.

Preferably, the core component defines a core first cross-sectional area and a core second cross-sectional area, the core first cross-sectional area being insertable into the base channel and the core second cross-sectional area protruding through the channel opening when the core first cross-sectional area is inserted into the base channel; the retaining strip being adhesively secured to the core second cross-sectional area and to the base member.

Preferably, the frame member has a generally U-shaped cross-sectional configuration defining a frame base wall and a pair of frame side walls; the frame base wall defining a base wall inner surface, a base wall outer surface and a pair of opposed base wall main peripheral edges; each of the frame side walls defining a corresponding side wall inner surface, a side wall outer surface, a side wall first main edge and a generally opposed side wall second main edge; each of the side wall first main edges being attached to a corresponding one of the base wall main peripheral edges; the frame side walls extending from the frame base wall so that the side wall inner surfaces are in a generally facing relationship relative to each other, the frame base wall and the frame side walls together forming the base channel; each of the frame side walls including a retaining flange extending inwardly from the side wall inner surface adjacent the side wall second main edge;

the core component having a generally rectangular cross-sectional configuration defining a core first main wall, a core second main wall, a core first auxiliary wall and a core second auxiliary wall; the core component being configured and sized so as to be insertable into the base channel with the core first main wall positioned generally adjacent the base wall inner surface and the core first and second auxiliary walls positioned generally adjacent a corresponding one of the side wall inner surface; the core first auxiliary wall being provided with a first retaining slot extending longitudinally at least partially therealong, the first retaining slot being configured and sized for receiving at least a section of one of the retaining flanges when the core component is inserted into the base channel; the core second auxiliary wall being provided with a second retaining slot extending longitudinally at least partially therealong, the second retaining slot being configured and sized for receiving at least a section of the other one of the retaining flanges when the core component is inserted into the base channel;

the first and second retaining slots extending generally transversally towards each other in a generally transversal slot plane, the slot plane extending generally between the core first cross-sectional area and the core second cross-sectional area, the retaining strip being adhesively secured to the core second cross-sectional area and to at least one of the frame side walls.

Preferably, the transversal movement limiting means includes at least one retaining flange extending from the frame member, the retaining flange being configured and sized for abutting against a section of the core component when the latter is inserted in the base channel.

Alternatively, the longitudinal movement limiting means includes an abutment tab extending inwardly into the base channel, the abutment tab being configured, sized and positioned so as to abuttingly contact the core second longitudinal end when the core component is in the core first position.

Preferably, the frame member has a generally U-shaped cross-sectional configuration defining a frame base wall and a pair of frame side walls; the frame base wall defining a base wall inner surface, a base wall outer surface and a pair of opposed base wall main peripheral edges; each of the frame side walls defining a corresponding side wall inner surface, a side wall outer surface, a side wall first main edge and a generally opposed side wall second main edge; each of the side wall first main edges being attached to a corresponding one of the base wall main peripheral edges; the frame side walls extending from the frame base wall so that the side wall inner surfaces are in a generally facing relationship relative to each other, the frame base wall and the frame side walls together forming the base channel; each of the frame side walls including a retaining flange extending inwardly from the side wall inner surface adjacent the side wall second main edge;

the core component has a generally rectangular cross-sectional configuration defining a core first main wall, a core second main wall, a core first auxiliary wall and a core second auxiliary wall; the core component being configured and sized so as to be insertable into the base channel with the core first main wall positioned generally adjacent the base wall inner surface and the core first and second auxiliary walls positioned generally adjacent a corresponding one of the side wall inner surface; the core first auxiliary wall being provided with a first retaining slot extending longitudinally at least partially therealong, the first retaining slot being configured and sized for receiving at least a section of one of the retaining flanges when the core component is inserted into the base channel; the core second auxiliary wall being provided with a second retaining slot extending longitudinally at least partially therealong, the second retaining slot being configured and sized for receiving at least a section of the other one of the retaining flanges when the core component is inserted into the base channel;

the first and second retaining slots extending generally transversally towards each other in a generally transversal slot plane, the slot plane generally between the core first cross-sectional area and the core second cross-sectional area;

the abutment tab extending inwardly from the frame base wall.

Alternatively, the longitudinal movement limiting means includes a retaining aperture extending through the frame member and a retaining component, the retaining aperture being configured, sized and positioned so that the retaining component is insertable into both the retaining aperture and the core component when the core component is in the core first position.

Preferably, the retaining component has a generally elongated and pointed configuration.

Typically, the longitudinal movement limiting means only allows longitudinal movement of the core component in the core first direction, the longitudinal movement limiting means preventing the core component from moving in the core second direction.

Alternatively, the longitudinal movement limiting means includes a gripping tab extending from the frame member into the base channel, the gripping tab being configured and sized so as to allow movement of the core component in the core first direction while preventing movement of the core component in the core second direction by gripping into the core component.

Preferably, the gripping tab defines a tab contacting segment for contacting the core component and a tab spacing segment extending between the frame member and the tab contacting segment for inwardly spacing the tab contacting segment from the frame member, the tab contacting segment defining a tab gripping end for gripping into the core component when the core component is moved in the core second direction.

Preferably, the gripping tab is movable between a tab first position wherein the tab gripping end is spaced by a first tab-to-frame distance from the frame member and a tab second position wherein the tab gripping end is spaced by a second tab-to-frame distance from the frame member, the first tab-to-frame distance being greater then the second tab-to-frame distance.

Preferably, the composite stud also includes a tab biasing means positioned between the frame member and the gripping tab for biasing the gripping tab towards the tab first position.

Preferably, the tab biasing means includes the gripping tab being made out of a resiliently deformable material.

Alternatively, the longitudinal movement limiting means includes a stud projection connected to the core component and an elongate guide channel located in the frame member, the stud projection being slidably mounted in the guide channel.

Preferably, the elongate guide channel is configured, sized and positioned to abuttingly engage the stud projection when the core component moves between the core first position and the core second position.

Other objects and advantages of the present invention will become apparent from a careful reading of the detailed description provided herein, with appropriate reference to the accompanying drawings.

BRIEF DESCRIPTION OF THE DRAWINGS

Embodiments of the present invention will now be disclosed, by way of example, in reference to the following drawings in which like reference characters indicate like elements throughout.

DETAILED DESCRIPTION OF THE PREFERRED EMBODIMENTS

With reference to the annexed drawings the preferred embodiments of the present invention will be herein described for indicative purpose and by no means as of limitation.

Figure 1:
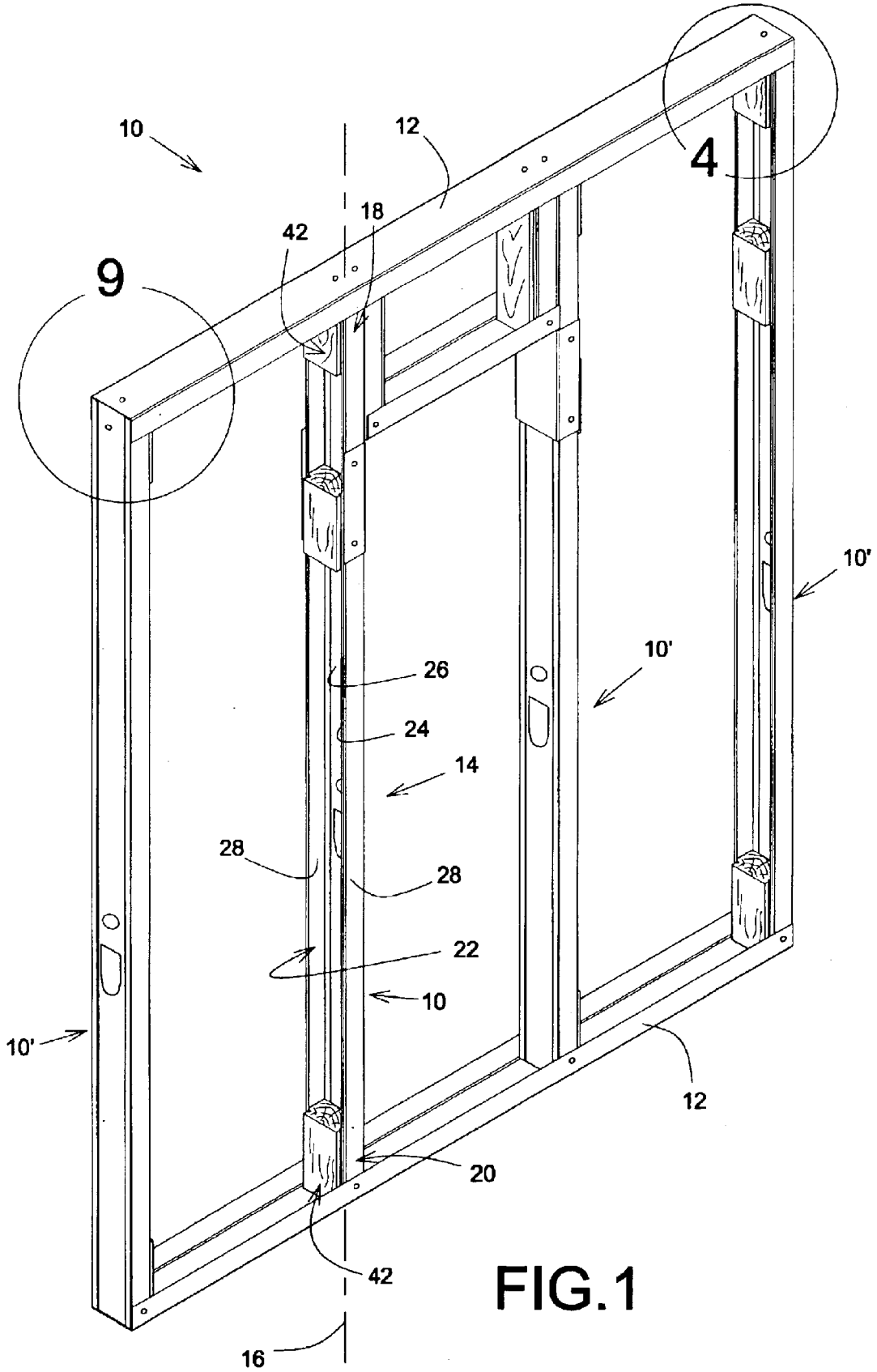
FIG. 1, in a perspective view, illustrates a length adjustable composite stud in accordance with an embodiment of the present invention, the length adjustable composite stud being shown used with similar length adjustable composite studs and with horizontal plate components attached thereto for forming a skeleton frame structure part of a conventional partition wall.

Referring to FIG. 1, there is shown a length adjustable composite stud 10 in accordance with an embodiment of the present invention. The length adjustable composite stud 10 is shown being used with other composite studs 10' for supporting conventional horizontal end plates 12. The length adjustable composite studs 10, 10' and the end plates 12 are shown assembled together for forming the skeleton frame of a conventional wall.

The length adjustable composite stud 10 includes a generally elongated frame member 14. The frame member 14 defines a frame longitudinal axis 16, a frame first longitudinal end 18 and a generally opposed frame second longitudinal end 20. The frame member 14 defines a generally open base channel 22 having a channel opening 24.

Typically, the frame member 14 has a generally U-shaped cross-sectional configuration defining a frame base wall 26 and a pair of frame side walls 28. As shown more specifically in FIGS. 2 through 6, the frame base wall 26 defines a base wall inner surface 30, a base wall outer surface 32 and a pair of opposed base wall main peripheral edges.

Each of the frame side walls 28 defines a corresponding side wall inner surface 34, a side wall outer surface 36, a side wall first main edge 38 and a generally opposed side wall second main edge 40. Each of the sidewall first main edges 38 is attached to a corresponding one of the base wall main peripheral edges.

The frame side walls 28 extend from the frame base wall 26 so that the side wall inner surfaces 34 are in a generally facing relationship relative to each other. The frame base wall 26 and the frame side walls 28 thus together form the base channel 22. It should be understood that although the frame member 14 is shown throughout the figures as having a generally U-shaped cross-sectional configuration, the frame member 14 could have other cross-sectional configurations without departing from the scope of the present invention.

The composite stud 10 also includes a core component 42. The core component 42 defines a core longitudinal axis 44, a core first longitudinal end 46 and an opposed core second longitudinal end 48. The core component 42 is configured and sized for allowing the core component 42 to be at least partially inserted in the base channel 22 with the core longitudinal axis 44 in a generally parallel relationship relative to the frame longitudinal axis 16.

The composite stud 10 further includes a transversal movement limiting means positioned between the frame member 14 and the core component 42 for preventing relative movement between the core component 42 and the frame member 14 in a direction other than the frame longitudinal axis 16. Typically, the transversal movement limiting means includes one and preferably two keepers or retaining flanges 50 extending from the frame member 14. Typically, each retaining flange 50 extends inwardly from one of the side wall inner surfaces 34 adjacent a side wall second main edge 40. The retaining flanges 50 are configured and sized for abutting against a section of the core component 42 when the latter is inserted in the base channel 22.

Typically, each core component 42 has a generally rectangular cross-sectional configuration defining a core first main wall 52, a core second main wall 54, a core first auxiliary wall 56 and a core second auxiliary wall 58. The core component 42 is typically configured and sized so as to be insertable into the base channel 22 with the core first main wall 52 positioned generally adjacent the base wall inner surface 30 and the core first and second auxiliary walls 56, 58 positioned generally adjacent a corresponding one of the side wall inner surfaces 34.

The core first and second auxiliary walls 56, 58 are typically provided respectively with a first and a second retaining slot 60, 62 extending longitudinally at least partially therealong. The first and second retaining slots 60, 62 are configured and sized for receiving at least a section of a corresponding one of the retaining flanges 50 when the core component 42 is inserted into the base channel 22.

It should be understood that although component 42 is shown as having a generally rectangular cross-sectional configuration, the core component 42 could have other configurations without departing from the scope of the present invention. Also, although the transversal movement limiting means is shown as including retaining flanges 50, it should be understood that the transversal movement retaining means could include other components also without departing from the scope of the present invention.

Figures 2, 3, 4, 5:
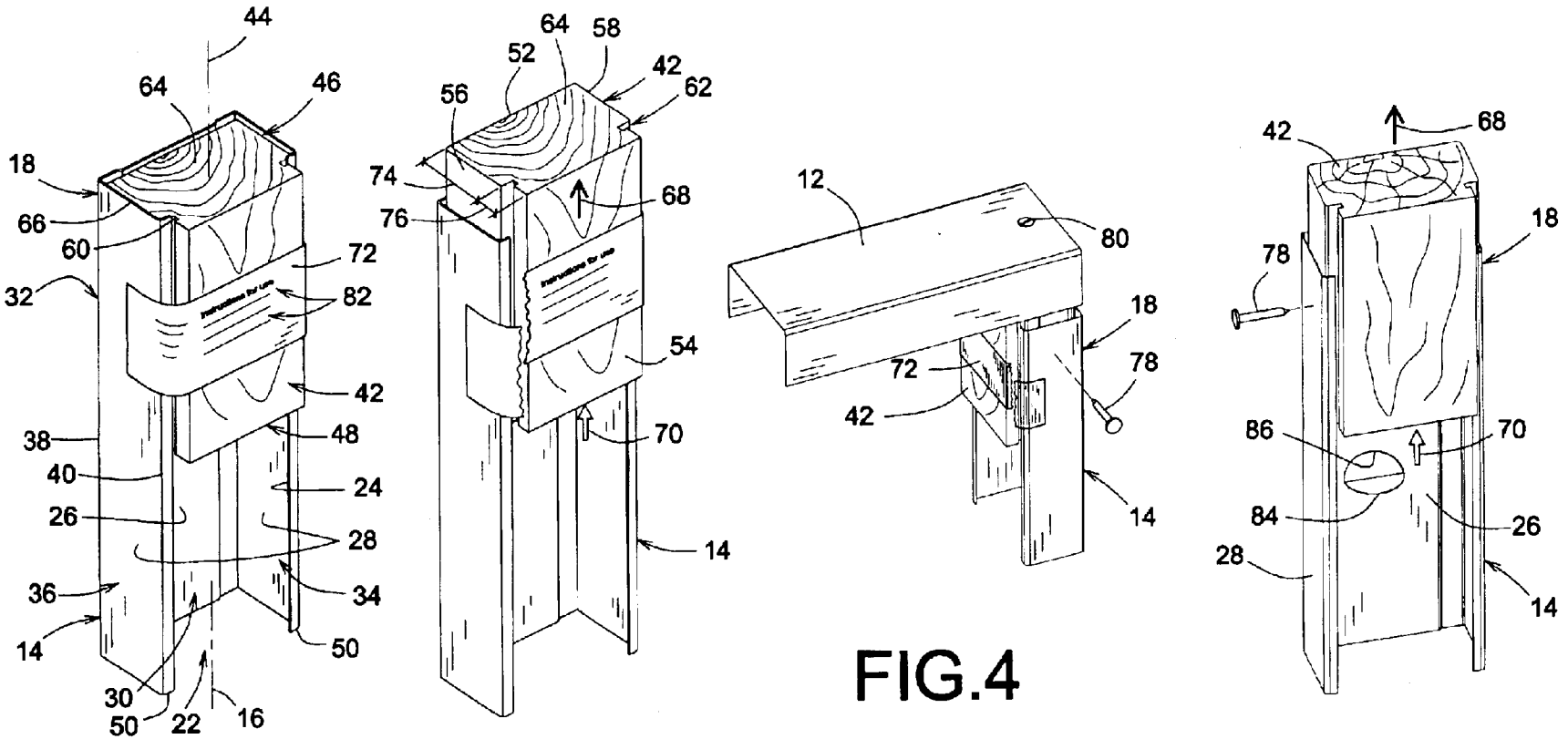
FIG. 2, in a partial perspective view, illustrates a length adjustable composite stud in accordance with a first embodiment of the present invention, the length adjustable composite stud being shown with its core component in a first position.
FIG. 3, in a partial perspective view, illustrates the length adjustable composite stud shown in FIG. 2 with its core component being moved towards a core second position.
FIG. 4, in a partial perspective view taken along line 4 of FIG. 1, illustrates the length adjustable composite stud shown in FIGS. 2 and 3 with its core component in a core second position and a with a section of a plate component attached thereto.
FIG. 5, in a partial perspective view, illustrates a length adjustable composite stud in accordance with a second embodiment of the present invention, the length adjustable composite stud being shown with its core component in a core second position.

The composite stud 10 still further includes longitudinal movement limiting means for releasably retaining the core component 42 within the base channel 22 in a core first position illustrated in FIG. 2 wherein the core first longitudinal end 46 is generally in register with the channel first longitudinal end 18. The longitudinal movement limiting means is positioned between the frame member 14 and the core component 42.

The core component 42 defines an anchoring surface 64 about the core first longitudinal end 46. The core anchoring surface 64 typically has a generally flat configuration.

The frame member 14 defines a frame first longitudinal edge 66 about the frame first longitudinal end 18. When the core component 42 is in the core first position, the core anchoring surface 64 and the frame first peripheral edge 66 typically extend in a generally common geometrical plane.

The longitudinal movement limiting means selectively allows longitudinal movement of the core component 42 in a core first direction indicated by arrow 68 towards a core second position upon a moving force 70 being applied on the core component 42. The core component 42 moving in the core first direction eventually reaches a core second position illustrated in FIGS. 3 through 6, wherein the core first longitudinal end 46 protrudes from the frame first longitudinal end 18. In other words, in the core second position, the core anchoring surface 64 is spaced outwardly in the direction of the core longitudinal axis 44 relative to the frame first peripheral edge 66.

In at least one embodiment of the invention, the longitudinal movement limiting means only allows longitudinal movement of the core component 42 in the core first direction 68 upon the moving force 70 reaching a predetermined value. In an embodiment of the invention shown in FIGS. 2 through 4, the longitudinal movement limiting means includes a retaining strip 72. The retaining strip 72 is secured to both the core component 42 and the frame member 14 for releasably preventing longitudinal movement therebetween.

In one embodiment of the invention, the retaining strip 72 is releasably secured to the core component 42 and/or to the frame member 14 so as to selectively allow longitudinal movement therebetween when the retaining strip 72 is removed from either or both the core component 42 and the frame member 14. For example, the retaining strip 72 could be releasable adhesively secured to the core component 42 and/or the frame member 14.

In another embodiment of the invention, the retaining strip 72 is made out of a tearable material. Typically, the tearable material is capable of being torn upon the moving force 70 reaching a predetermined value, or simply by using a knife or the like prior to applying the force 70.

Typically, the core component 42 defines a core first cross-sectional area 74 and a core second cross-sectional area 76. The core first cross-sectional area 74 is insertable into the base channel 22 while the core second cross-sectional area 76 protrudes from the channel opening 24 when the core first cross-sectional area 74 is inserted into the base channel 22.

Typically, the first and second retaining slots 60, 62 extend generally transversely towards each other in a generally transversal slot plane. The slot plane, in turn, extends generally between the core first and second cross-sectional areas 74, 76. The retaining strip 72 is typically adhesively secured to the core second cross-sectional area 76 and to the side wall outer surface 36 of at least one, and preferably both frame side walls 28.

The embodiment shown in FIGS. 2 through 4 is typically sold or otherwise provided with the core component 42 positioned in the core first position such as illustrated in FIG. 2. The core component 42 is prevented from longitudinal movement in the direction of the frame longitudinal axis 44 by the retaining strip 72 adhesively secured to both the frame member 14 and the core component 42.

If the length of the length adjustable stud 10 needs to be adjusted, the intended user merely needs to exert a moving force 70 in the direction of the core first direction. Upon the moving force 70 reaching a predetermined value, the retaining strip 72 will be torn allowing relative movement between the core component 42 and the frame member 14 as illustrated in FIG. 3.

Once the length of the length adjustable stud 10 has been adjusted, the core component 42 may be secured in the core second position using conventional fastening means such as a fastening nail 78 or the like inserted through both the frame member 14 and the core component 42. The anchoring surface 64 can then be used for securing a plate 12 using an anchoring screw 80 or other suitable means.

The retaining strip 72 is typically made out of a self-adhesive strip of paper, polymeric resin or the like being tearable upon a predetermined tearing force being applied thereon. Optionally, the retaining strip 72 is provided with indicia 82 printed or otherwise marked thereon. The indicia 82 may include identifying information and/or instructions relating to a method for using the length adjustable composite stud 10.

In another embodiment of the invention shown more specifically in FIG. 5, the longitudinal movement limiting means includes an abutment tab 84 extending inwardly into the base channel 22. The abutment tab 84 is configured, sized and positioned so as to abuttingly contact the core second longitudinal end 48 when the core component 42 is in the core first position.

Typically, the abutment tab 84 extends inwardly from the frame base wall 26. Alternatively, the abutment tab 84 could extend from the side walls 28, the retaining flanges 50 or any other suitable location. Typically, the abutment tab 84 has a generally half-disk shaped configuration. The abutment tab 84 could also have other configurations without departing from the scope of the present invention. Typically, the abutment tab 84 is punched-in during the manufacturing process, hence creating a corresponding adjacent cut-out 86.

In use, the core component 42 is allowed to be pushed towards the core second position by a moving force 70 exerted in the core first direction 68. Upon the core component 42 reaching the core second position, the core component 42 is again secured to the frame member 14 using suitable securing means such as the securing nail 78. An end plate 12 can then be secured to the anchoring surface 64 using an anchoring screw 80.

Figure 8A:
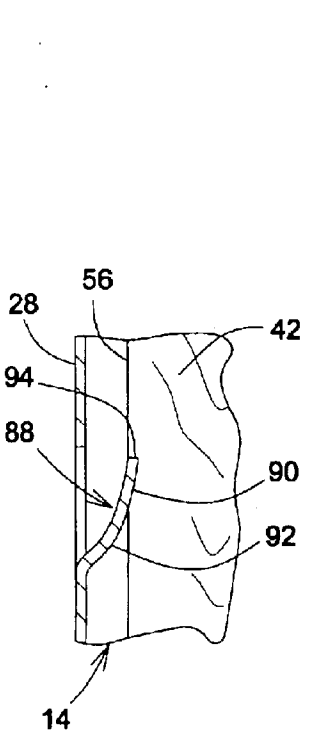
FIG. 8*a*, in an enlarged partial elevational view taken along line 8*a* of FIG. 8 with sections taken out, illustrates details of a gripping tab of the embodiment of FIG. 8.
Figure 8:
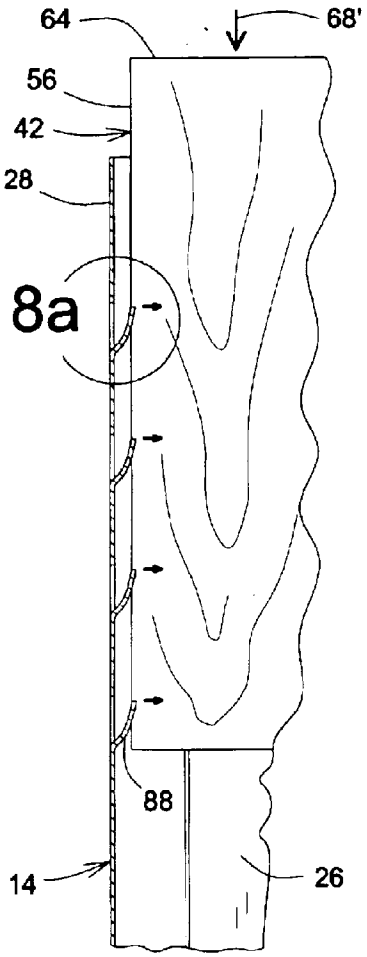
FIG. 8, in a view similar to FIG. 7, illustrates a length adjustable composite stud in accordance with an embodiment of the present invention, the length adjustable composite stud being shown with its core component being moved in a core second direction.
Figure 7:
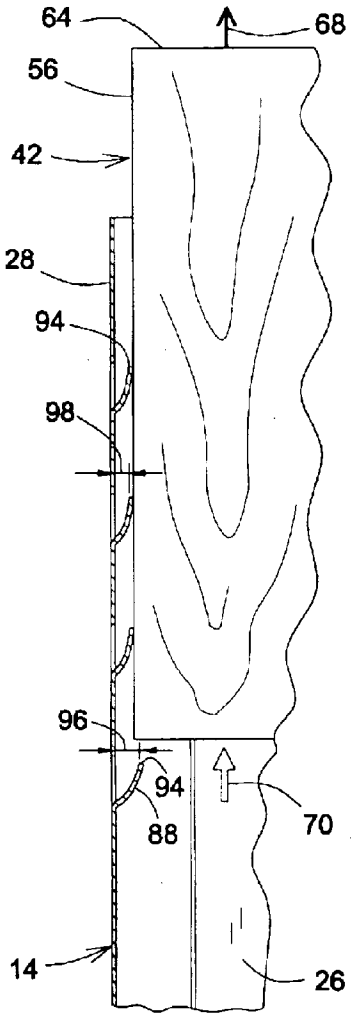
FIG. 7, in a partial elevational view taken along line 7—7 of FIG. 6 with sections taken out, illustrates a length adjustable composite stud in accordance with an embodiment of the present invention, with its core component being moved in a core first direction towards a core second position wherein it protrudes from the end section of the frame member.
Figure 6:
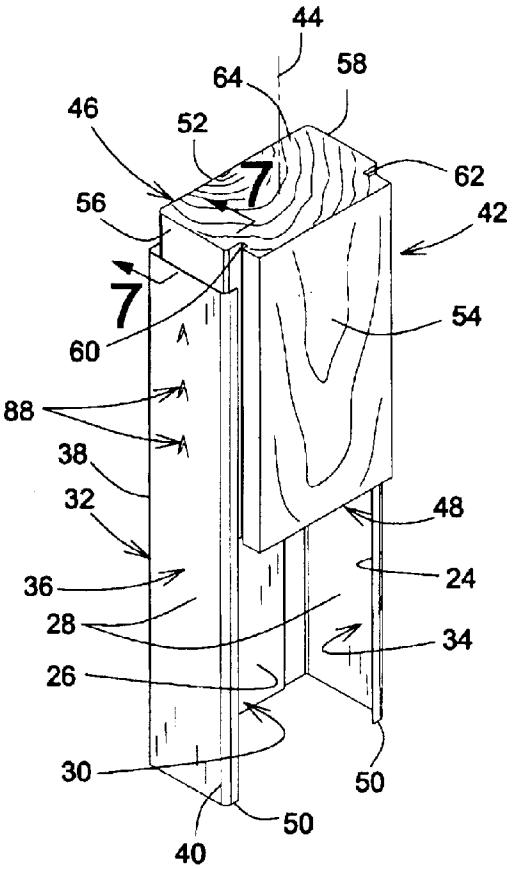
FIG. 6, in a partial perspective view, illustrates a length adjustable composite stud in accordance with an embodiment of the present invention, the length adjustable composite stud being shown with its core component in a core second position wherein it protrudes from the end section of the frame member.

Referring now more specifically to FIGS. 6 through 8, there is shown a length adjustable composite stud 10 in accordance with yet another embodiment of the invention. The composite stud 10 includes at least one gripping tab 88 extending from the frame member 14 into the base channel 22.

Preferably, the longitudinal movement limiting means includes a set of gripping tabs 88 longitudinally aligned in spaced apart relationship relative to each other and extending from both the frame side walls 28. Each gripping tab 88 is configured and sized so as to allow movement of the core component 42 in the core first direction 68 while preventing movement of the core component 42 in the opposite core second direction 68'.

Typically, as illustrated in FIG. 8*a,* each gripping tab 88 defines a tab contacting segment 90 for contacting the core component 42 and a tab spacing segment 92 extending between the frame member 14 and the tab contacting segment 90 for inwardly spacing the tab contacting segment 90 from the frame member 14. The tab contacting segment 90 defines a tab gripping end 94 for gripping into the core component 42 when the core component 42 is moved in the core second direction 68'.

As illustrated more specifically in FIG. 7, each gripping tab 88 is typically movable between a tab first position shown in the lower end of FIG. 7 wherein the tab gripping end 94 is spaced by a first tab-to-frame distance 96 from the frame member 14 and a tab second position shown in the upper end of FIG. 7 wherein the tab gripping end 94 is spaced by a second tab-to-frame distance 98 from the frame member 14. The first tab-to-frame distance 96 being greater then the second tab-to-frame distance 98.

Typically, the composite stud 10 also includes a tab biasing means positioned between the frame member 14 and the gripping tab 88 for biasing the gripping tab 88 towards the tab first position. Typically, the tab biasing means includes the gripping tab 88 being made out of a generally resilient deformable material such as a suitable metallic alloy.

Typically, each gripping tab 88 is punched out of one and preferably both the frame side walls 28. Also, typically, each gripping tab 88 has a generally triangular shaped configuration with the tip pointed towards the closest frame longitudinal end 16, 18. It should however be understood that the gripping tabs 88 could have other configurations without departing from the scope of the present invention.

In use, the longitudinal movement limiting means shown in FIGS. 6 to 8 only allows longitudinal movement of the core component 42 in the core first direction 68. The longitudinal movement limiting means prevents the core component 42 from moving in a core second direction 68' oriented opposite the core first direction 68.

As shown in FIG. 7, the core component 42 is allowed to slide in the core first direction 68 while abuttingly contacting the gripping tabs 88. The latter are biased towards the tab second position by the core second first and second auxiliary surfaces 56, 58. When the core component 42 is moved back in from the core second position, the tab gripping end 94 penetrates into the first and second core auxiliary surfaces 56, 58 for preventing further movement of the core component 42 in the core second direction 68'.

Figure 11:
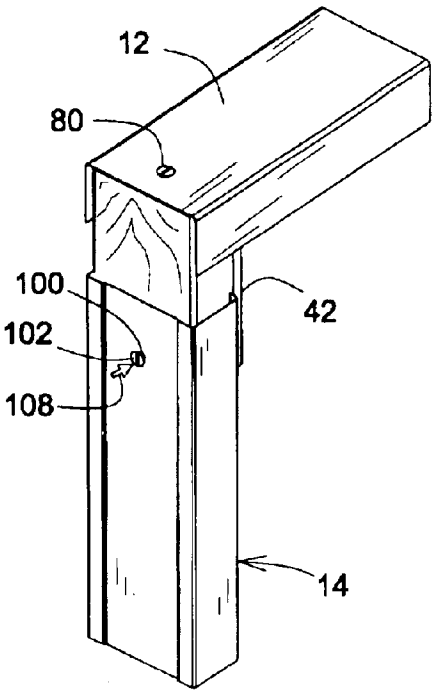
FIG. 11, in a partial elevational view with sections taken out, illustrates a length adjustable composite stud in accordance with an embodiment of the present invention with its core component fixed in a core second position wherein it protrudes from the frame member.
Figure 10:
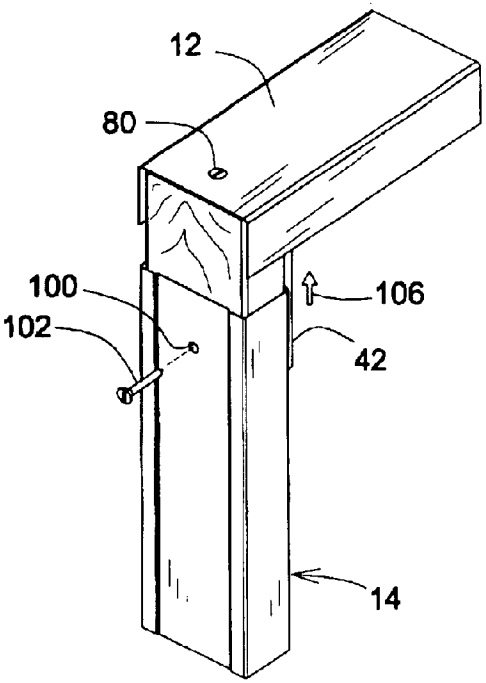
FIG. 10, in a partial elevational view with sections taken out, illustrates a length adjustable composite stud in accordance with an embodiment of the present invention with its core component being moved towards a core second position wherein it protrudes from the frame member.
Figure 9:
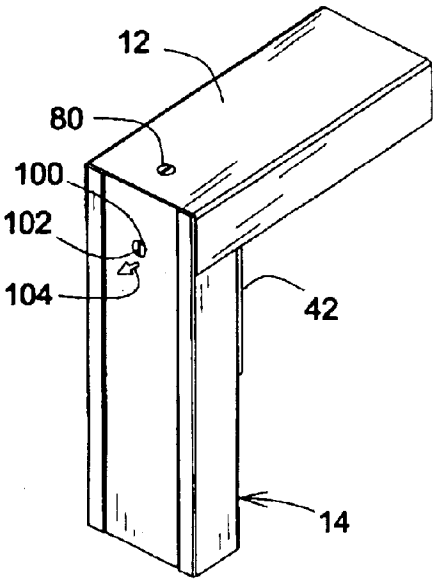
FIG. 9, in a partial elevational view taken along line 9 of FIG. 1 with sections taken out, illustrates a length adjustable composite stud in accordance with yet another embodiment of the present invention, the length adjustable composite stud being shown with its core component in a core first position wherein it is generally in register with the frame member.

Referring now more specifically to FIGS. 9 through 11, there is shown the steps of using a length adjustable composite stud 10 in accordance with still another embodiment of the present invention. In the embodiment shown in FIGS. 9 through 11, the longitudinal movement limiting means includes a retaining aperture 100 extending through the frame member 14 and a generally elongated retaining component 102. The retaining aperture 100 is configured, sized and positioned so that the retaining component 102 is insertable into both the retaining aperture 100 and the core component 42 when the core component 42 is in the core first position.

Once the end plate 12 is secured against the anchoring surface 64 of the core component 42 via the anchoring screw 80, the retaining component 102 is removed from the core component 42 and the retaining aperture 100, as shown by arrow 104 of FIG. 9. Then the length of the composite stud 10 is adjusted by longitudinally sliding the core component 42 along with the end plate 12 outwardly from the frame member 14 in a core second position, as shown by arrow 106 of FIG. 10. Finally, once in proper length, the retaining component 102 is re-inserted through the retaining aperture 100 into the core component 42 to secure the latter to the frame member 14, as shown by arrow 108 of FIG. 11.

Figure 13:
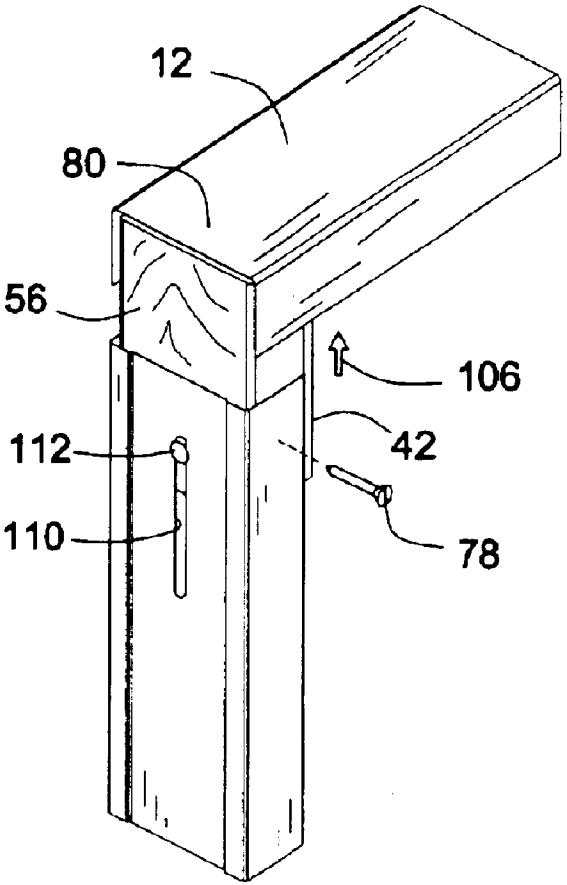
FIG. 13, in a partial elevational view with sections taken out, illustrates a length adjustable composite stud with its core component being moved towards a core second position wherein it protrudes from the frame member.
Figure 12:
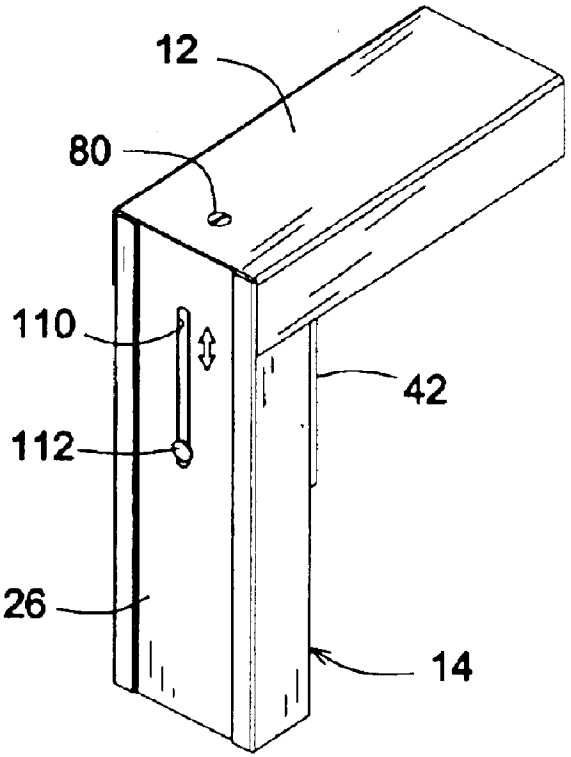
FIG. 12, in a partial elevational view with sections taken out, illustrates a length adjustable composite stud in accordance with yet another embodiment of the present invention, the length adjustable composite stud being shown with its core component in a core first position wherein it is generally in register with the frame member.

In another embodiment of the invention shown more specifically in FIGS. 12 and 13, the longitudinal movement limiting means includes an elongate guide channel 110 and a stud projection 112. The elongate guide channel 110 is located in the frame base wall 26, although the guide channel 110 may be located in the side walls 28. The stud projection 112 is secured in the core main first main wall 56 and is slidably mounted in the engage the guide channel 110. The guide channel 110 is configured so that the stud projection 112 abuttingly engages the ends of the guide channel 110 when the core component is moved between the core first position and the core second position, as shown in FIGS. 12 and 13 respectively. Once located in the second core position, the fastener 78 can be used to secure the core component 42 to the frame member 14.

Typically, the retaining component 102 has a generally elongated and pointed configuration. By way of example, the retaining component can take the form of a conventional retaining screw or the like.

Although the present length adjustable composite stud has been described with a certain degree of particularity, it is to be understood that the disclosure has been made by way of example only and that the present invention is not limited to the features of the embodiments described and illustrated herein, but includes all variations and modifications within the scope and spirit of the invention as hereinafter claimed.

I claim:

1. A length adjustable composite stud comprising:

a generally elongated frame member, said frame member defining a frame longitudinal axis, a frame first longitudinal end and a generally opposed frame second longitudinal end; said frame member defining a generally open base channel, said base channel having a longitudinal channel opening;

a core component, said core component defining a core longitudinal axis, a core first longitudinal end and an opposed core second longitudinal end; said core component being at least partially insertable in said base channel with said core longitudinal axis in a generally parallel relationship relative to said frame longitudinal axis to form said composite stud therewith, said core component being axially and slidably movable relative to said frame member when at least partially inserted within said base channel;

transversal movement limiting means positioned between said frame member and said core component for preventing relative movement between said core component and said frame member in a direction other then said frame longitudinal axis when said core component is at least partially inserted within said base channel;

longitudinal movement limiting means positioned between said frame member and said core component for releasably retaining said core component within said base channel in a core first position wherein said core first longitudinal end is generally in register with said frame first longitudinal end, said longitudinal movement limiting means selectively allowing longitudinal movement of said core component in a core first direction towards a core second position upon a moving force being applied on said core component, wherein when said core component is in said core second position, said core first longitudinal end protrudes from said frame first longitudinal end so as to adjust a length of said composite stud, while preventing said core component to be axially moved relative to said base frame from said core first position in a core second direction oriented opposite said core first direction.

2. A length adjustable composite stud as recited in claim 1 wherein said longitudinal movement limiting means only allows longitudinal movement of said core component in said core first direction upon said moving force reaching a predetermined value.

3. A length adjustable composite stud as recited in claim 1 wherein said core component is in said core first position and wherein said longitudinal movement limiting means includes a retaining strip, said retaining strip being secured to both said core component and said frame member for releasably preventing longitudinal movement therebetween said retaining strip extending generally circumferentially relative to said core component and said frame member.

4. A length adjustable composite stud as recited in claim 3 wherein said retaining strip is releasably secured to said core component and said frame member for selectively allowing longitudinal movement therebetween.

5. A length adjustable composite stud as recited in claim 3 wherein said retaining strip is made out of a tearable material, said tearable material being tearable upon said moving force reaching a predetermined value.

6. A length adjustable composite stud as recited in claim 3 wherein said retaining strip is provided with indicia marked thereon.

7. A length adjustable composite stud as recited in claim 6 wherein said indicia includes instructions relating to a method for using said length adjustable composite stud.

8. A length adjustable composite stud as recited in claim 3 wherein said core component defines a core first cross-sectional area and a core second cross-sectional area, said core first cross-sectional area being insertable into said base channel and said core second cross-sectional area protruding through said channel opening when said core first cross-sectional area is inserted into said base channel; said retaining strip being adhesively secured to said core second cross-sectional area and to said base member.

9. A length adjustable composite stud as recited in claim 8 wherein:

said frame member has a generally U-shaped cross-sectional configuration defining a frame base wall and a pair of frame side walls; said frame base wall defining a base wall inner surface, a base wall outer surface and a pair of opposed base wall main peripheral edges; each of said frame side walls defining a corresponding side wall inner surface, a side wall outer surface, a side wall first main edge and a generally opposed side wall second main edge; each of said side wall first main edges being attached to a corresponding one of said base wall main peripheral edges; said frame side walls extending from said frame base wall so that said side wall inner surfaces are in a generally facing relationship relative to each other, said frame base wall and said frame side walls together forming said base channel; each of said frame side walls including a retaining flange extending inwardly from said side wall inner surface adjacent said side wall second main edge;

said core component having a generally rectangular cross-sectional configuration defining a core first main wall, a core second main wall, a core first auxiliary wall and a core second auxiliary wall; said core component being configured and sized so as to be insertable into said base channel with said core first main wall positioned generally adjacent said base wall inner surface and said core first and second auxiliary walls positioned generally adjacent a corresponding one of said side wall inner surface; said core first auxiliary wall being provided with a first retaining slot extending longitudinally at least partially therealong, said first retaining slot being configured and sized for receiving at least a section of one of said retaining flanges when said core component is inserted into said base channel; said core second auxiliary wall being provided with a second retaining slot extending longitudinally at least partially therealong, said second retaining slot being configured and sized for receiving at least a section of the other one of said retaining flanges when said core component is inserted into said base channel;

said first and second retaining slots extending generally transversally towards each other in a generally transversal slot plane, said slot plane extending generally between said core first cross-sectional area and said core second cross-sectional area, said retaining strip being adhesively secured to said core second cross-sectional area and to at least one of said frame side walls.

10. A length adjustable composite stud as recited in claim 9 wherein said retaining strip extends between said frame side walls over said core second cross-sectional area, said retaining strip being adhesively secured to said core second cross-sectional area and to the side wall outer surface of both said frame side walls.

11. A length adjustable composite stud as recited in claim 1 wherein said transversal movement limiting means includes at least one retaining flange extending from said frame member, said retaining flange being configured and sized for abutting against a section of said core component when the latter is inserted in said base channel.

12. A length adjustable composite stud as recited in claim 1 wherein said longitudinal movement limiting means includes an abutment tab extending inwardly into said base channel, said abutment tab being configured, sized and positioned so as to abuttingly contact said core second longitudinal end when said core component is in said core first position.

13. A length adjustable composite stud as recited in claim 12 wherein:

said frame member has a generally U-shaped cross-sectional configuration defining a frame base wall and a pair of frame side walls; said frame base wall defining a base wall inner surface, a base wall outer surface and a pair of opposed base wall main peripheral edges; each of said frame side walls defining a corresponding side wall inner surface, a side wall outer surface, a side wall first main edge and a generally opposed side wail second main edge; each of said side wall first main edges being attached to a corresponding one of said base wall main peripheral edges; said frame side walls extending from said frame base wall so that said side wall inner surfaces are in a generally facing relationship relative to each other, said frame base wall and said frame side walls together forming said base channel; each of said frame side walls including a retaining flange extending inwardly from said side wall inner surface adjacent said side wall second main edge;

said core component has a generally rectangular cross-sectional configuration defining a core first main wall, a core second main wall, a core first auxiliary wall and a core second auxiliary wall; said core component being configured and sized so as to be insertable into said base channel with said core first main wall positioned generally adjacent said base wall inner surface and said core first and second auxiliary walls positioned generally adjacent a corresponding one of said side wall inner surface; said core first auxiliary wall being provided with a first retaining slot extending longitudinally at least partially therealong, said first retaining slot being configured and sized for receiving at least a section of one of said retaining flanges when said core component is inserted into said base channel; said core second auxiliary wall being provided with a second retaining slot extending longitudinally at least partially therealong, said second retaining slot being configured and sized for receiving at least a section of the other one of said retaining flanges when said core component is inserted into said base channel;

said first and second retaining slots extending generally transversally towards each other in a generally transversal slot plane, said slot plane generally between said core first cross-sectional area and said core second cross-sectional area;

said abutment tab extending inwardly from said frame base wall.

14. A length adjustable composite stud as recited in claim 1 wherein said longitudinal movement limiting means includes a retaining aperture extending through said frame member and a retaining component, said retaining aperture being configured, sized and positioned so that said retaining component is insertable into both said retaining aperture and said core component when said core component is in said core first position.

15. A length adjustable composite stud as recited in claim 14 wherein said retaining component has a generally elongated and pointed configuration.

16. A length adjustable composite stud as recited in claim 1 wherein said longitudinal movement limiting means only allows longitudinal movement of said core component in said core first direction, said longitudinal movement limiting means preventing said core component from moving in said core second direction.

17. A length adjustable composite stud as recited in claim 16 wherein said longitudinal movement limiting means includes a gripping tab extending from said frame member into said base channel, said gripping tab being configured and sized so as to allow movement of said core component in said core first direction while preventing movement of said core component in said core second direction by gripping into said core component.

18. A length adjustable composite stud as recited in claim 17 wherein said gripping tab defines a tab contacting segment for contacting said core component and a tab spacing segment extending between said frame member and said tab contacting segment for inwardly spacing said tab contacting segment from said frame member, said tab contacting segment defining a tab gripping end for gripping into said core component when said core component is moved in said core second direction.

19. A length adjustable composite stud as recited in claim 18 wherein said gripping tab is movable between a tab first position wherein said tab gripping end is spaced by a first tab-to-frame distance from said frame member and a tab second position wherein said tab gripping end is spaced by a second tab-to-frame distance from said frame member, said first tab-to-frame distance being greater then said second tab-to-frame distance.

20. A length adjustable composite stud as recited in claim 19 wherein said composite stud also includes a tab biasing means positioned between said frame member and said gripping tab for biasing said gripping tab towards said tab first position.

21. A length adjustable composite stud as recited in claim 20 wherein said tab biasing means includes said gripping tab being made out of a resiliently deformable material.

22. A length adjustable composite stud as recited in claim 1 wherein said longitudinal movement limiting means includes a stud projection connected to said core component and an elongate guide channel located in said frame member, said stud projection being slidably mounted in said guide channel.

23. A length adjustable composite stud as recited in claim 22 wherein said elongate guide channel is configured, sized and positioned to abuttingly engage said stud projection when said core component moves between said core first position and said core second position.

* * * * *